US005811933A

United States Patent [19]

Van Den Nieuwenhuizen et al.

[11] Patent Number: 5,811,933

[45] Date of Patent: Sep. 22, 1998

[54] HIGH-PRESSURE DISCHARGE LAMP

[75] Inventors: Hubertus C.M. Van Den Nieuwenhuizen; Martinus J.M. Kessels; Gerardus M.J.F. Luijks; Willem J. Van Den Hoek; Hendrik M. Bleeker, all of Eindhoven, Netherlands

[73] Assignee: U.S. Philips Corporation, New York, N.Y.

[21] Appl. No.: 795,164

[22] Filed: Feb. 7, 1997

[30] Foreign Application Priority Data

Jul. 11, 1996 [EP] European Pat. Off. ..... 96201951

[51] Int. Cl.[6] ..... H01J 61/34

[52] U.S. Cl. ..... 313/570; 313/25; 313/27; 313/634

[58] Field of Search ..... 313/570, 25, 27, 313/634, 595, 596, 601

[56] References Cited

U.S. PATENT DOCUMENTS

| | | | |
|---|---|---|---|
| 4,818,915 | 4/1989 | Zaslavsky et al. | 315/60 |
| 4,987,344 | 1/1991 | Zaslavsky et al. | 315/59 |
| 5,323,087 | 6/1994 | Zaslavsky et al. | 313/631 X |
| 5,323,091 | 6/1994 | Morris | 313/634 X |
| 5,397,259 | 3/1995 | Zaslavsky et al. | 445/29 |
| 5,550,421 | 8/1996 | Scholz et al. | 313/25 |
| 5,646,484 | 7/1997 | Myojo et al. | 313/595 |
| 5,680,000 | 10/1997 | Zuk et al. | 313/25 |

FOREIGN PATENT DOCUMENTS

| | | | |
|---|---|---|---|
| 201107 | 11/1981 | German Dem. Rep. | A61N 5/06 |

*Primary Examiner*—Ashok Patel
*Attorney, Agent, or Firm*—F. Brice Faller

[57] ABSTRACT

The invention relates to a high-pressure discharge lamp provided with a discharge vessel which is enclosed with intervening space by an outer bulb with a lamp cap, which lamp also comprises an UV-enhancer having a wall and an internal electrode and arranged in the space between outer bulb and discharge vessel.

According to the invention, the wall of the UV-enhancer is made from ceramic material.

The invention offers the advantage that the lamp ignites reliably at a comparatively low ignition voltage of 3 kV already.

7 Claims, 1 Drawing Sheet

HIGH-PRESSURE DISCHARGE LAMP

BACKGROUND OF THE INVENTION

The invention relates to a high-pressure discharge lamp with a discharge vessel which is enclosed with intervening space by an outer bulb provided with a lamp cap, which lamp also comprises a UV-enhancer provided with a wall and an internal electrode and arranged in the space between the outer bulb and the discharge vessel.

A lamp of the kind mentioned in the opening paragraph is known from U.S. Pat. No. 4,818,915. The known lamp is a high-pressure discharge lamp, more in particular a metal halide lamp.

Such a lamp is suitable for various applications such as general interior lighting, general exterior lighting, video illumination, etc. The discharge vessel of the known lamp is made of quartz glass. It is alternatively possible, however, for this vessel to be made of ceramic material. Ceramic material in the present description and claims is understood to be a densely sintered polycrystalline metal oxide such as, for example, $Al_2O_3$ or YAG and densely sintered polycrystalline metal nitride such as, for example, AlN.

A known problem of this type of lamp is the comparatively wide spread in ignition time. This points to a shortage of free electrons during lamp ignition. The addition of a small quantity of $^{85}Kr$ in the discharge vessel can supplement such a shortage. A disadvantage of this, however, is that $^{85}Kr$ is radioactive. Efforts have been made to avoid this through the use of a UV-enhancer, which is a small UV discharge tube positioned adjacent the discharge vessel and acting as a UV source. The UV-enhancer in the known lamp is formed by a UV-transmitting quartz tube. Upon breakdown, the UV-enhancer will generate said UV-radiation. The influence of this UV-radiation leads to the production of free electrons in the discharge vessel, which in their turn strongly promote lamp ignition. It is true that the use of the UV-enhancer in the known lamp leads to an improvement in situations where ignition voltage pulses of the order of 5 kV are useful and admissible. Under many circumstances occurring in practice, however, it is desirable or even required that the ignition voltage pulses should not substantially exceed a level of 3 kV.

SUMMARY OF THE INVENTION

The invention has for its object to provide a measure by which the above problem is counteracted. According to the invention, a lamp of the kind mentioned in the opening paragraph is for this purpose characterized in that the wall of the UV-enhancer is made from ceramic material.

It is surprisingly found that the probability of breakdown upon the application of an ignition pulse rises strongly both in the UV-enhancer and in the discharge vessel owing to the presence of a UV-enhancer whose wall is made of ceramic material. The increased breakdown probability manifests itself in a drop in the minimum ignition pulse value required for a reliable lamp ignition. This is the more remarkable as the use of ceramic material for the discharge vessel does not have any appreciable favorable influence on the spread in ignition times in high-pressure discharge lamps.

A further advantage of the UV-enhancer according to the invention is the very good heat resistance of ceramic materials. This renders it possible to position the UV-enhancer at a very small distance from the discharge vessel. The good heat resistance of the UV-enhancer according to the invention also allows for its use in a lamp having a ceramic discharge vessel.

In a preferred embodiment, the UV-enhancer has a wall which is made from densely sintered polycrystalline $Al_2O_3$. The fact that this is widely used as a wall material for high-pressure discharge lamps has the major practical advantage that an existing technology for ceramic discharge vessels can be utilized. A very high degree of miniaturization is possible here.

Although it was found that a combination of a rare gas and Hg is suitable as a filling, the UV-enhancer preferably has a rare gas filling. Suitable is inter alia Ne. Ar was found to be particularly suitable as a filling. A pressure (filling pressure) is preferably chosen for the filling which accompanies a minimum breakdown voltage. This filling pressure may be readily ascertained experimentally. A fair approximation can be realized by means of the Paschen curve. A mixture of rare gases in the form of a Penning mixture is also suitable.

A major advantage of a rare gas filling is that not only the use of radioactive substances ($^{85}Kr$) but also that of heavy metal (Hg) is eliminated in the manufacture of the UV-enhancer. Surprisingly, free electrons are generated in such quantities upon breakdown in a rare gas filling that lamp ignition is strongly promoted.

The UV-enhancer may be constructed as a discharge vessel having two internal electrodes between which the discharge takes place. Preferably, the UV-enhancer is provided with one internal electrode and is mounted in the space surrounded by the outer bulb in such a manner relative to a current supply conductor to the discharge vessel that a capacitive coupling between the UV-enhancer and the current supply conductor is achieved. An important advantage is the strongly simplified construction of the UV-enhancer made possible thereby, which in its turn facilitates further miniaturization.

BRIEF DESCRIPTION OF THE DRAWINGS

The above and further aspects of the lamp according to the invention will be explained in more detail with reference to a drawing (not true to scale), in which.

DESCRIPTION OF THE PREFERRED EMBODIMENTS

Figure 1:
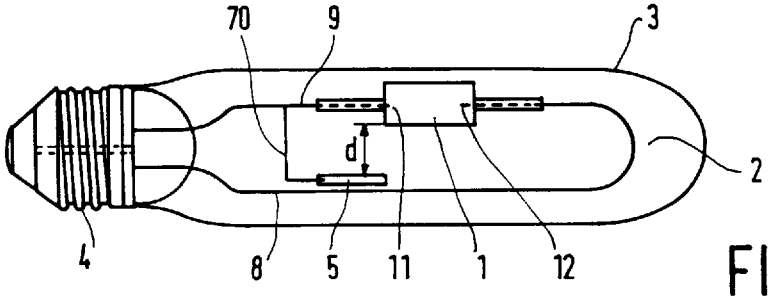
FIG. 1 is a side elevation of a lamp according to the invention.

FIG. 1 shows a high-pressure metal halide lamp with a discharge vessel 1 which is enclosed with intervening space 2 by an outer bulb 3 which has a lamp cap 4. The lamp comprises a UV-enhancer 5 in the space between the outer bulb and the discharge vessel. A lead-through conductor 70 of the UV-enhancer is connected to a current supply conductor 9 which connects an internal electrode 11 of the discharge vessel to a contact point of the lamp cap 4. A further current supply conductor 8 forms an electrical connection between an internal electrode 12 of the discharge vessel 1 and a further contact point of the lamp cap 4. The UV-enhancer is so positioned relative to the current supply conductor 8 that a capacitive coupling is achieved.

Figure 2:
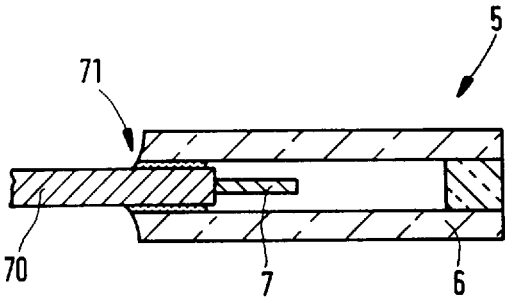
FIG. 2 shows a UV-enhancer of the lamp of FIG. 1 in detail.

The UV-enhancer shown in more detail in FIG. 2 has a wall 6 and an internal electrode 7. The wall 6 of the UV-enhancer 5 is made of ceramic material here. In a practical realization of the UV-enhancer, the wall is made from densely sintered polycrystalline $Al_2O_3$.

The internal electrode 7 of the UV-enhancer is connected to a lead-through conductor 70 which is passed through the wall of the UV-enhancer via a gastight lead-through passage 71. The lead-through conductor is an Nb-rod in a practical embodiment. A W-rod is used as the electrode. It is alternatively possible to have the Nb-rod itself act as the electrode.

In a practical realization, the UV-enhancer has an external length of 12 mm, an external diameter of 2 mm, an internal diameter of 0.66 mm, and a greatest internal length of 9 mm. The W-rod of 2 mm length and 170 $\mu$m diameter is welded to an Nb lead-through conductor of 620 $\mu$m diameter.

The UV-enhancer contains Ar with a filling pressure of 170 mbar. Preferably, the filling pressure lies between 50 mbar and 300 mbar.

For comparison, it should be noted that commercially available UV-enhancers with a quartz or quartz-glass wall have an external length of 25 mm and a diameter of 5 mm.

A series of lamps was subjected to an ignition test. The lamps are 39 W CDM lamps, make Philips, connected to a supply voltage source of 220 V, 50 Hz via a stabilizer ballast provided with an igniter circuit. These lamps have ceramic discharge vessels with fillings comprising metal halide. The ceramic material of the discharge vessel reaches a temperature of between 800° C. and 1000° C. during lamp operation. The igniter circuit comprises a starter of the Sn 57 type, make Philips. This starter is widely used for igniting high-pressure discharge lamps and supplies ignition pulses with a maximum value of 2.3 kV and a pulse width of 10 $\mu$s.

A number of lamps from the series was provided with a ceramic UV-enhancer of the embodiment described above. Another group of the lamps was provided with a ceramic UV-enhancer with a filling of Ar and 0.5 mg Hg. For comparison, lamps without UV-enhancer and lamps comprising UV-enhancers according to the prior art were subjected to the same ignition test.

The UV-enhancers are capacitively coupled to one of the current supply conductors of the lamp.

The test results show that the lamps with ceramic UV-enhancers all ignite within a few tenths of a second. This means that both breakdown in the UV-enhancer and subsequent breakdown in the discharge vessel take place within a few tenths of a second. The lamps without UV-enhancers do not ignite, while only some of the lamps having UV-enhancers according to the prior art ignite, and indeed with major delays of up to several seconds. A similar test with metal halide lamps having quartz glass discharge vessels and a power rating of 70 W gave a similar result.

Figure 3:
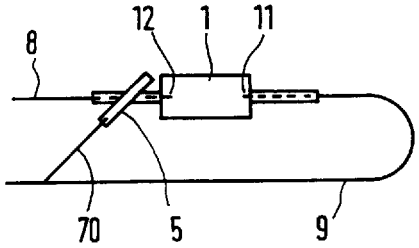
FIG. 3 diagrammatically shows a positioning of the UV-enhancer relative to a discharge vessel of the lamp.

The UV-enhancer should be positioned at a very small distance from the discharge vessel to promote a fast and reliable ignition of the lamp according to the invention. This is possible in the manner as shown in FIG. 1, for example, where the UV-enhancer is positioned parallel to and at a distance d from the discharge vessel. Preferably, the distance d in such an arrangement is at most 10 mm. Another favorable positioning of the UV-enhancer is behind an electrode adjacent the lead-through conductor at an angle (of e.g. 45°) to the longitudinal axis of the discharge vessel, as depicted diagrammatically in FIG. 3. Positioning the UV-enhancer at such a small distance from the discharge vessel requires a very good heat resistance of the wall of the UV-enhancer. The wall temperature of the UV-enhancer will lie above 600° C. for prolonged periods during lamp operation, in particular if the lamp has a ceramic discharge vessel.

We claim:

1. A high-pressure discharge lamp comprising a discharge vessel;

an outer bulb enclosing said discharge vessel with an intervening space between the outer bulb and the discharge vessel, the outer bulb provided with a lamp cap;

a UV-enhancer provided with a wall and an internal electrode, said UV-enhancer arranged in the space between the outer bulb and the discharge vessel, characterized in that; the wall of the UV-enhancer is made from ceramic material.

2. A lamp as claimed in claim 1, characterized in that the wall of the UV-enhancer is made from densely sintered polycrystalline $Al_2O_3$.

3. A lamp as claimed in claim 2, characterized in that the UV-enhancer has a rare gas filling.

4. A lamp as claimed in claim 3, characterized in that the rare gas filling comprises Ar.

5. A lamp as claimed in claim 4, characterized in that the filling pressure of the rare gas filling lies between 50 mbar and 300 mbar.

6. A lamp as claimed in claim 3, characterized in that the filling pressure of the rare gas filling lies between 50 mbar and 300 mbar.

7. A lamp as claimed in claim 1, characterized in that the UV-enhancer has a rare gas filling.

* * * * *